United States Patent [19]

Graser

[11] 4,378,878

[45] Apr. 5, 1983

[54] CROWN SUPPORT CARRIER

[75] Inventor: Earl J. Graser, Monroe, La.

[73] Assignee: Manville Service Corporation, Denver, Colo.

[21] Appl. No.: 294,109

[22] Filed: Aug. 19, 1981

[51] Int. Cl.[3] ..... B65D 25/22; B65D 5/50

[52] U.S. Cl. ..... 206/153; 206/147; 206/161; 229/52 BC; 229/29 F; 229/28 BC

[58] Field of Search ..... 206/427, 434, 145, 147, 206/148, 158, 161, 152, 153; 229/35, 32, 49, 52 B, 40, 28 BC, 29 F, 89; 224/15

[56] References Cited

U.S. PATENT DOCUMENTS

| | | | |
|---|---|---|---|
| 1,896,326 | 2/1933 | Northway-Ley | 229/89 |
| 2,320,440 | 6/1943 | Kruea et al. | 224/15 |
| 3,154,827 | 11/1964 | Gentry | 206/152 X |
| 3,876,066 | 4/1975 | Klygis | 206/158 |
| 4,029,207 | 6/1977 | Gordon | 206/427 |
| 4,190,149 | 2/1980 | Oliff et al. | 206/145 |
| 4,304,329 | 12/1981 | Graser | 206/148 |

*Primary Examiner*—Steven M. Pollard
*Assistant Examiner*—Bryon P. Gehman
*Attorney, Agent, or Firm*—R. M. Halvorsen; J. D. Lister

[57] ABSTRACT

A novel crown support carrier is disclosed having a generally one-piece construction formed in an inverted U-shaped configuration. A pair of downwardly depending legs are formed on the apex of the U-shape and tape means are applied to the lower corner portions of each leg to tightly pull the downwardly positioned legs against the bottles contained in the carrier to thereby form a tightly secured beverage carrier. The tape means has indicia designating printing positioned thereon in the form of advertising or other copy material. In the preferred embodiments, the carrier is designed for two or six bottle capacity but may be used for other combinations of bottles such as three, four, five or more than six bottles.

1 Claim, 4 Drawing Figures

Fig. 1
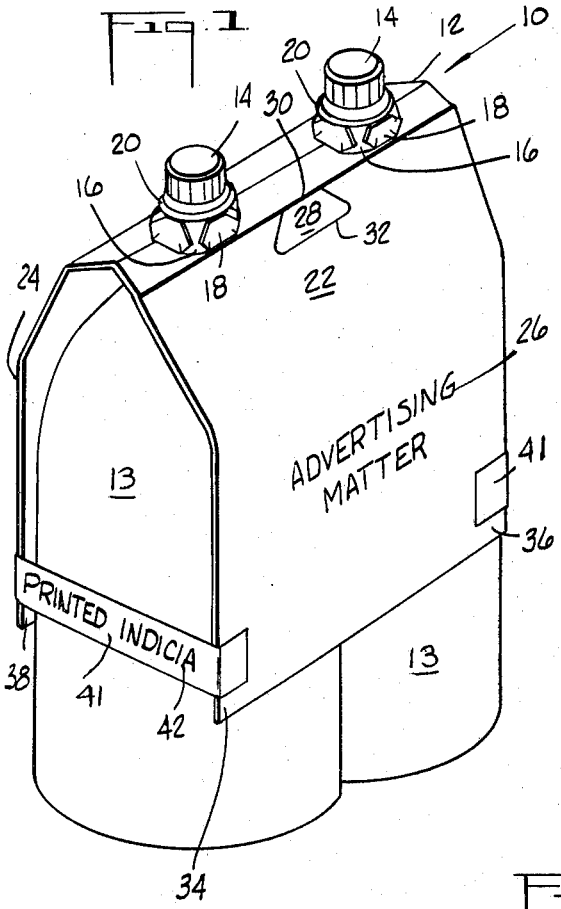
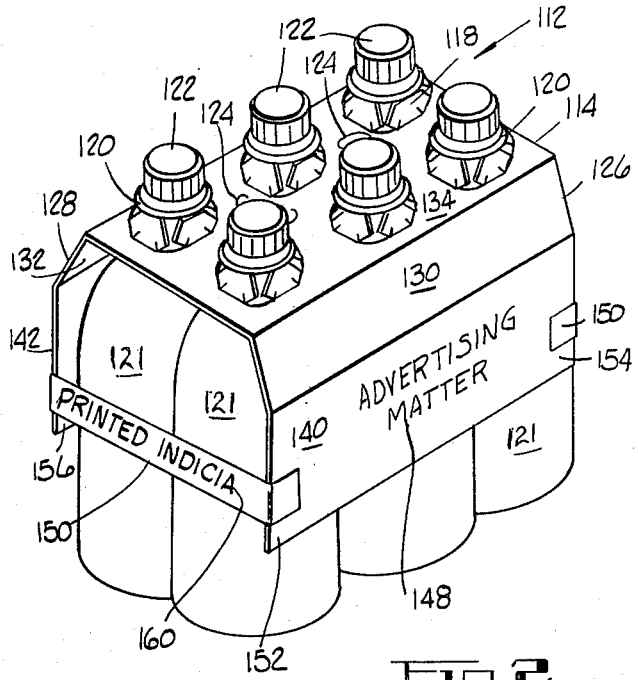
Fig. 2
Fig. 3
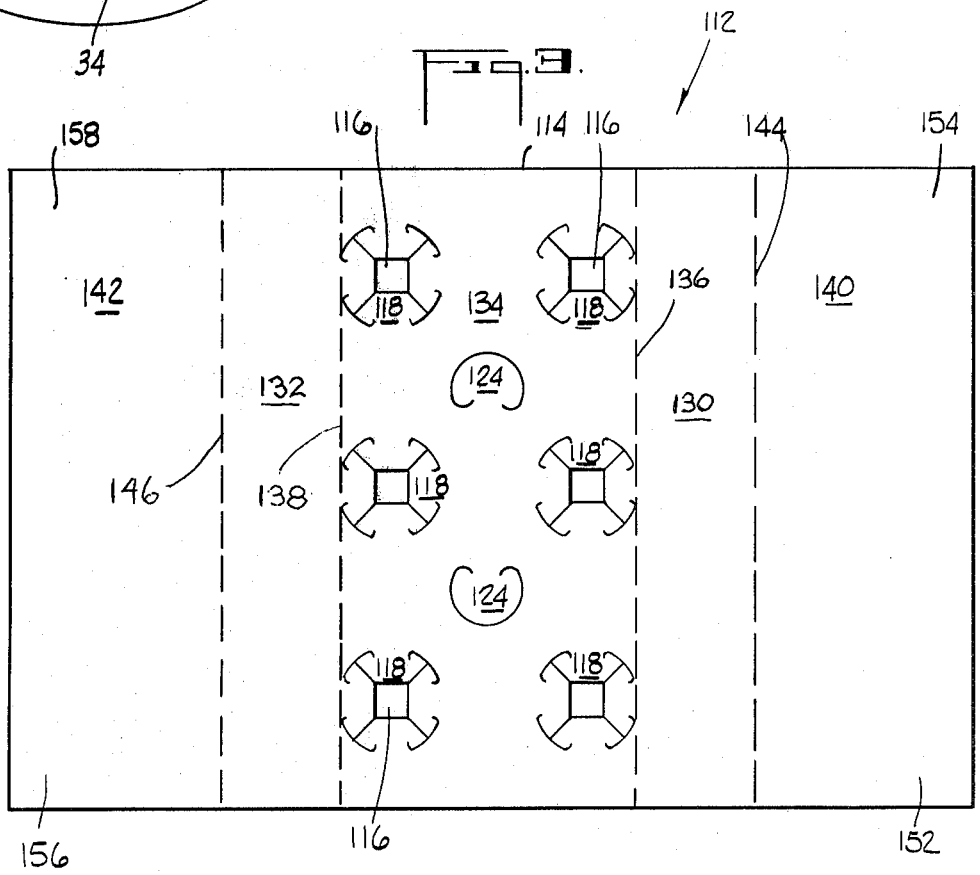

CROWN SUPPORT CARRIER

BACKGROUND OF THE INVENTION

This invention relates generally to crown support carriers for beverage bottles and more particularly to a new and improved crown support carrier having an elongated advertising panel positioned over opposite sides of the carrier with tape means applied to the lower portion of the opposite sides to tightly contain the bottles within the carrier.

It is known in the art of crown support carriers to provide various forms of a crown support carrier wherein a plurality of bottle necks are positioned through the carrier and supported by the necks of the bottles at the openings. Carriers have been designed having downwardly depending side panels and end panels and in various combinations thereof for the express purpose of providing advertising space on the panels and also for the purpose of attempting to tightly contain the bottles in the carrier.

These prior art type carriers utilizing downwardly depending side panels and end panels in combination with a crown support carrier generally have not been able to tightly pull the various panels together through locking means formed on the panels or through other means in order to assure that the bottles are retained within the carrier tightly.

SUMMARY OF THE INVENTION

In order to alleviate the problems encountered with the beforementioned type of crown support carriers, there has been provided by the subject invention, a new and novel crown support carrier having a generally one-piece inverted U-shaped carrier for retaining a plurality of bottles having a plurality of bottle receiving openings positioned in the apex of the U-shape. The bottle openings have formed thereon a plurality of sunburst bottle retaining tabs. A handle means is formed on the carrier for purposes of transporting the carrier. A downwardly depending elongated panel or leg is hingedly attached to the apex of the U-shape and is positioned on each side of the bottle receiving openings. The elongated panel may be utilized for advertising matter of the type common in the beverage industry. The two downward depending legs have attached thereto at the lower corner thereof tape means which spans the beverage bottles contained in the erected filled carrier. The tape means serves to pull the opposite legs of the carrier tightly against the bottles thereby effecting a tightly formed beverage package. The tape means may have applied thereto indicia designating printing which may take the form of additional advertising or other printing formed on the tape means.

Accordingly, it is an object and advantage of the invention to provide a new and novel crown support carrier which may be tightly positioned around the bottles contained in the carrier by means of a tape means adhered to the bottom of two downwardly depending side panels formed on the carrier.

Another object and advantage of the invention is to provide a new and novel crown support carrier which may be utilized for transporting two, three, four, five, six or more bottles within the carrier with modifications being made in the structure of the carrier to accommodate more or less bottles.

Still yet another object and advantage of the invention is to provide a new and improved crown support carrier formed from a one-piece production blank which may be quickly set up in the bottling plant with a minimal use of machinery and utilizing existing adhesive taping machines that may be adapted to work in conjunction with the Applicant's carrier.

These and other objects and advantages of the invention will become apparent from a review of the drawings and from a study of the specification describing the preferred embodiment.

DESCRIPTION OF THE DRAWINGS

FIG. 1 is a perspective view of the Applicant's crown support carrier showing it utilized on a two-bottle package of beverage bottles and showing the tape means applied to the lower corner of the downwardly depending legs of the invention;

FIG. 2 is a perspective view of the Applicant's new and novel crown support carrier showing it utilized with a six-bottle package of beverage bottles;

FIG. 3 is a plan view of the production blank of the carrier shown in FIG. 2.

DESCRIPTION OF THE PREFERRED EMBODIMENT

Figure 4:
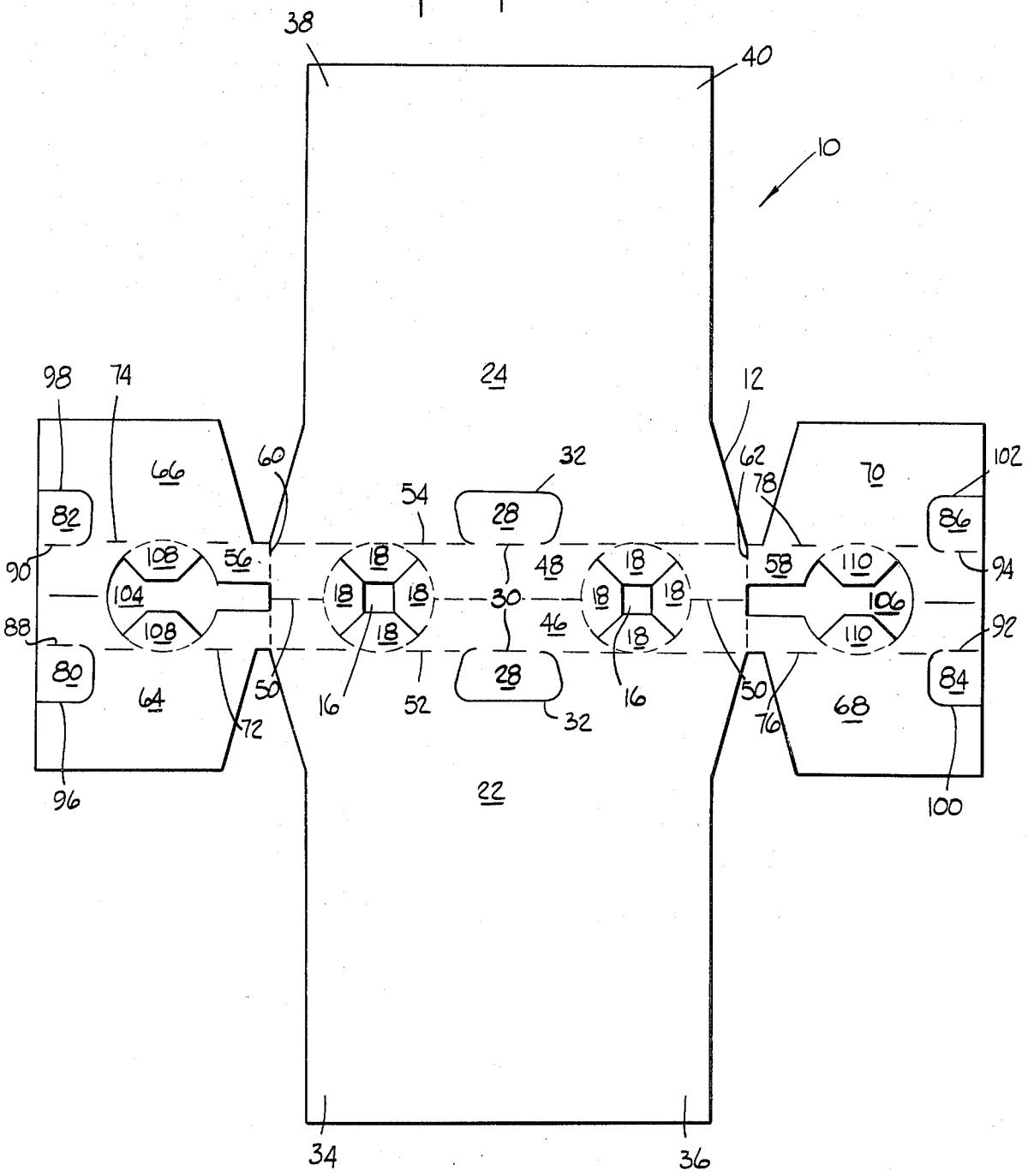
FIG. 4 is a plan view of the production blank of the carrier shown in FIG. 1 of the drawings.

Referring now to FIG. 1 of the drawing, there is shown a preferred embodiment of the Applicant's new and novel two bottle crown support carrier generally by the numeral 10 which comprises a generally one-piece inverted U-shaped beverage carrier blank 12 for a plurality of beverage bottles 13 with beverage bottle caps 14 positioned within a plurality of bottle receiving openings 16 contained in the apex of the U-shaped portion.

The bottle openings 16 have formed therein a plurality of sunburst bottle retaining tabs 18 designed to be positioned under the necks 20 of the bottles 13 contained in the carrier. The carrier also has hingedly attached to the apex of the U-shape at least two downwardly depending legs 22 and 24 which are formed on each side of the bottle receiving openings and may contain advertising matter 26 as shown in the drawing. The length of the downwardly depending legs depends on the extent of the advertising matter desired to be contained on the legs 22 and 24 and to a greater extent is dependent upon the desires of the purchaser of the carrier blank and how the various leg lengths appeal to his particular eye.

A handle means is formed in the upper portion of the downwardly depending legs 22 and 24 in the vicinity of the apex of the U-shape for carrying the filled carrier by the consumer. The handle means is formed by the use of a plurality of hinged handle tabs 28 which are hinged on the hinge line 30 and are die cut from the legs 22 and 24 by means of the die cut 32.

Positioned on the lower corners 34 and 36 of leg 22 and the lower corners 38 and 40 of the leg 24 are tape means in the form of a paper backed adhesive-type tape 41 which is adhered to the lower corners 34, 36, 38 and 40 and span the beverage bottles 13 contained in the erected filled carrier. The tape 41 serves to pull the opposite legs of the carrier tightly against the bottles 13 thereby effecting a tightly formed beverage package. Printed indicia 42 may be formed on the adhesive tape 41 for purposes of carrying additional advertising or for whatever printed matter is desirous of applying to the tape means. When formed thusly, it can be seen that the new and novel crown support carrier is formed as a simplified package which may be tightly positioned around the filled bottles contained in the carrier thereby minimizing bottle drop-out problems in the carrier.

Referring now to FIG. 4 of the drawing, there is shown a plan view of the production blank of the carrier shown in FIG. 1 and it can be seen how the basic carrier blank may be improved by the addition of top reinforcing panels to reinforce the apex of the U-shape to thereby strengthen the carrier when utilized with large type bottles of the liter size. The two-bottle crown support carrier of the Applicant's invention comprises a pair of central panels 46 and 48 hingedly attached together by means of a score line 50 and has positioned therein at least two bottle receiving openings 16 as has been beforementioned. Each bottle receiving opening 16 has formed thereon a plurality of sunburst neck receiving tabs 18 of the type known in the prior art. The downwardly depending legs 22 and 24 form the elongated panels which are hingedly attached to each central panel by means of the score lines 52 and 54. The elongated panels 22 and 24 contain the handle means hereinbefore described for carrying the erected container with the handle means comprising the openings formed by the handle tabs 28.

When it is desirous to provide additional strength to the central panels 46 and 48 and the upper part of the carrier there would be formed a pair of top reinforcing panels 56 and 58 which would be hingedly attached on opposite ends of each pair of central panels 46 and 48 by means of the score lines 60 and 62. Each top reinforcing panel 56 and 58 has formed thereon on opposite sides thereof a side reinforcing panel 64, 66, 68 and 70 by means of the score lines 72, 74, 76 and 78.

The side reinforcing panels 64, 66, 68 and 70 also have formed therein partial handle openings formed by a handle tab 80, 82, 84 and 86 which are hingedly attached by means of the score lines 88, 90, 92 and 94. The partial handle tabs 80, 82, 84 and 86 are also die cut from their respective side reinforcing panels by means of the die cuts 96, 98, 100 and 102.

Each top reinforcing panel 56 and 58 also has formed therein bottle receiving openings 104 and 106 and has formed thereon at least two sunburst neck receiving tabs 108 and 110 which are formed in a position so as to be adjacent to the bottle receiving openings 16 and the sunburst tabs 18 formed in the central panels 46 and 48.

When erecting the production blank shown in FIG. 4, the top reinforcing panels 56 and 58 with their attaching side reinforcing panels 64, 66, 68 and 70 would be folded about the score lines 60 and 62 and would be positioned beneath the apex of the U-shaped carrier and would lie in juxtaposition to the central panels 46 and 48 and a portion of the downwardly depending legs 22 and 24. The top reinforcing panels 56 and 58 along with their side reinforcing panels 64, 66, 68 and 70 may be adhesively secured to the underside of the U-shaped carrier 12 by adhesive means as is known in the art in order to further strengthen the upper portion of the carrier. When formed thusly, the openings 16 will align with the openings 104 and 106 in the top reinforcing panel 56 and 58 and the partial handle tabs 80, 82, 84 and 86 will align with the handle tabs 28 formed on the downwardly depending legs 22 and 24. Should it be desirous to form the carrier 10 without a reinforcing panel, then it would be obvious that the top reinforcing panels 56 and 58 along with their side reinforcing panels 64, 66, 68 and 70 would be eliminated by severing these panels from the main carrier at the score lines 60 and 62. It is also within the spirit and scope of the invention that other top panel reinforcing means may be designed into the carton should it be desirous, such as reinforcing the central panels 46 and 48 by othe means such as adhesive tape or additional panels separately glued to those areas.

Referring now to FIG. 2 of the drawing, there is shown the Applicant's new and novel crown support carrier designed in the form of a six-pack carrier shown generally by the numeral 112 which comprises a generally one-piece inverted U-shaped beverage carrier blank 114 having a plurality of bottle receiving openings 116 positioned in the apex of the U-shape. The bottle openings 116 also have formed therein a plurality of sunburst bottle retaining tabs 118 of the type known in the art. The sunburst bottle retaining tabs 118 are designed to be positioned beneath the necks 120 of the bottles 121 and the bottle caps 122 and to retain the bottles 121 in the carrier whenever the carrier is transported by the consumer. The apex of the U-shape also has formed therein handle means in the form of a pair of handle tabs 124 better shown in FIG. 3 of the drawing.

At least two downwardly depending legs 126 and 128 are formed by means of a pair of first elongated panels 130 and 132 which are hingedly attached to a central panel 134 by means of the score lines 136 and 138. Each first elongated panel 130 and 132 has hingedly attached thereto a second elongated panel 140 and 142 by means of the score lines 144 and 146. The second elongated panels 140 and 142 as well as the first elongated panels 130 and 132 may have advertising matter 148 applied thereto of the type desired by the purchaser of the production blank. The length of the second elongated panels 140 and 142 is dependent upon the desires of the production blank purchaser and would probably be sufficient to cover a large portion of the bottles 121 contained in the carrier. When the carrier is erected as shown in FIG. 2 then a tape means in the form of a paper backed adhesive-type tape 150 would be applied to the lower corners 152, 154, 156 and 158 of the second elongated panels 140 and 142. When applied thusly, the tape 150 could be used to pull the second elongated panels 140 and 142 tightly on both sides of the carrier against the bottles 122 contained in the carrier 112 thereby minimizing bottle drop-out whenever the carrier is transported. The tape 150 may also have applied thereto printed indicia 160 in the form of further advertising matter or other indicia as desired by the customer to enhance the appearance of the package or to convey various information such as a uniform product code identification or the like. It is within the spirit and scope of the invention that the downwardly depending legs 126 and 128 of the six-pack carrier may also be formed with only one pair of elongated panels which would be bent around the outer bottles in a manner similar to the construction of the carrier shown in FIG. 1 instead of being formed with first elongated panels 130 and 132 and second elongated panels 140 and 142. By referring to FIG. 3 of the drawing, there can be seen a plan view of the production blank for the preferred embodiment six-pack carrier shown in FIG. 2 of the drawing and utilizing a pair of two panel downwardly depending legs 126 and 128 and 140 and 142.

From the foregoing it can be seen that there has been provided by the subject invention, a new and novel crown support carrier formed for various numbers of bottles to be contained in the carrier which accomplishes all of the objects and advantages of the invention. Nevertheless it is apparent that changes may be made in the carrier and in the various arrangement of the respective parts of the carrier without departing from the spirit and scope of the invention and the invention should not be limited to the exact matters shown which have been given by way of illustration only.

Having described my invention, I claim:

1. The production blank for a crown support carrier comprising:

(a) a pair of central panels hingedly attached together, the central panels having positioned therein at least two bottle receiving openings, each bottle receiving opening having formed thereon a plurality of sunburst neck receiving tabs;

(b) an elongated panel hingedly attached to each central panel, each elongated panel having formed thereon handle means for carrying the erected container; and (c) a pair of top reinforcing panels, hingedly attached on opposite ends of each pair of central panels for folding beneath the central panels whenever the carrier is erected, each top reinforcing panel having formed thereon on opposite sides thereof a side reinforcing panel hingedly attached to the top reinforcing panel and having formed thereon partial handle openings formed by a handle tab and positioned adjacent the handle means formed on the elongated panels, each top reinforcing panel also having formed thereon bottle receiving openings having formed thereon sunburst neck receiving tabs formed adjacent to the bottle receiving openings and the neck receiving tabs formed on the central panels of the crown support carrier production blank.

* * * * *